US008220447B1

(12) United States Patent
Harrison

(10) Patent No.: US 8,220,447 B1
(45) Date of Patent: Jul. 17, 2012

(54) RAPID FIRE BLOW GUN TOY WITH AN AMMUNITION CHAMBER HAVING A SQUEEZABLE HANDLE

(76) Inventor: Justin David Harrison, Huntington Beach, CA (US)

( * ) Notice: Subject to any disclaimer, the term of this patent is extended or adjusted under 35 U.S.C. 154(b) by 0 days.

(21) Appl. No.: 13/465,022

(22) Filed: May 6, 2012

Related U.S. Application Data

(63) Continuation of application No. 13/026,206, filed on Feb. 11, 2011, now Pat. No. 8,191,542.

(51) Int. Cl.
*F41B 1/00* (2006.01)

(52) U.S. Cl. ..... 124/62

(58) Field of Classification Search ..... 124/62, 124/83, 10, 82, 20.2; 42/54
See application file for complete search history.

(56) References Cited

U.S. PATENT DOCUMENTS

| | | | | |
|---|---|---|---|---|
| 1,122,421 | A * | 12/1914 | Redington et al. | 124/62 |
| 2,580,613 | A * | 1/1952 | Seibel et al. | 124/62 |
| 3,236,521 | A * | 2/1966 | Knott | 473/457 |
| 6,347,621 | B1 * | 2/2002 | Guthrie | 124/48 |
| 2006/0042615 | A1 * | 3/2006 | Gregory | 124/62 |

* cited by examiner

*Primary Examiner* — Michael Carone
*Assistant Examiner* — Reginald Tillman, Jr.
(74) *Attorney, Agent, or Firm* — Barcelo, Harrison & Walker, LLC

(57) ABSTRACT

A blow gun includes an ammunition chamber having an internal volume that is large enough to hold at least 30 spherical projectiles, for example plastic BBs. The ammunition chamber has a breath receiving orifice for receiving exhaled breath into the ammunition chamber. A barrel obtrudes from the ammunition chamber. The barrel has a cylindrical bore therethrough, that defines an internal diameter that is greater than the spherical projectile diameter but no greater than 1.7 times the spherical projectile diameter. The ammunition chamber includes a resilient handle portion that is squeezable to displace spherical projectiles within the ammunition chamber.

16 Claims, 5 Drawing Sheets

RAPID FIRE BLOW GUN TOY WITH AN AMMUNITION CHAMBER HAVING A SQUEEZABLE HANDLE

CROSS-REFERENCE TO RELATED APPLICATIONS

This application claims the benefit under 35 U.S.C. §120 as a continuation of pending U.S. patent application Ser. No. 13/026,206, entitled "RAPID FIRE BLOW GUN TOY," filed on Feb. 11, 2011.

BACKGROUND

There is significant commercial demand for toys that can fire hard plastic BB projectiles. A category of such toys are known in the art as so-called "airsoft" guns. Although the BB projectiles comprise hard plastic, they are less dangerous than metal BB projectiles because they are less massive and therefore carry less momentum at a given velocity. Hence, airsoft players often fire airsoft guns at other players during airsoft games and competitions, without significant injury (so long as eyes are well protected).

Contemporary toy guns that are capable of rapidly firing hard plastic BB projectiles have relatively complex design, requiring many stationary and moving parts and sometimes also a source of gas pressure or electrical energy. Such complexity of design undesirably increases the material and fabrication costs associated with toy gun manufacture, may reduce gun reliability and useable lifespan, and may limit gun miniaturization for concealment. Hence, there is a need in the art for a toy gun that is capable of rapidly firing BB projectiles, and that has a simpler, smaller, cheaper, and/or more reliable design.

Blow guns are well known in the art, however most contemporary blow guns are designed to fire only one projectile at a time, and are not capable of firing multiple projectiles. Other blow guns may be capable of firing multiple projectiles, but with substantially increased design complexity, and at a firing rate that may be undesirably low. For example, U.S. Pat. No. 5,544,642 to Guthrie discloses a multi-projectile blow gun, but its firing rate is relatively low, and its design is relatively complex. Hence, there is a need in the art for a blow gun that is capable of firing multiple projectiles with a rapid firing rate, and/or that has a simpler, smaller, cheaper, and/or more reliable design.

DESCRIPTION OF PREFERRED EMBODIMENTS

Figure 1A:
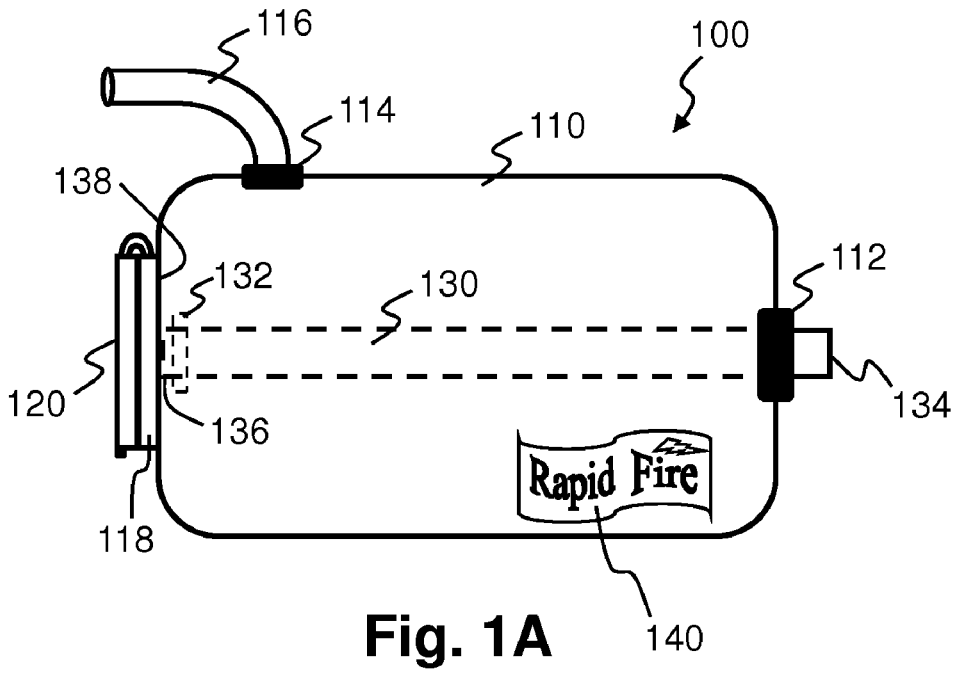
FIG. 1A is a top view of an unloaded blow gun according to an embodiment of the present invention, with its barrel in the storage position.
Figure 1B:
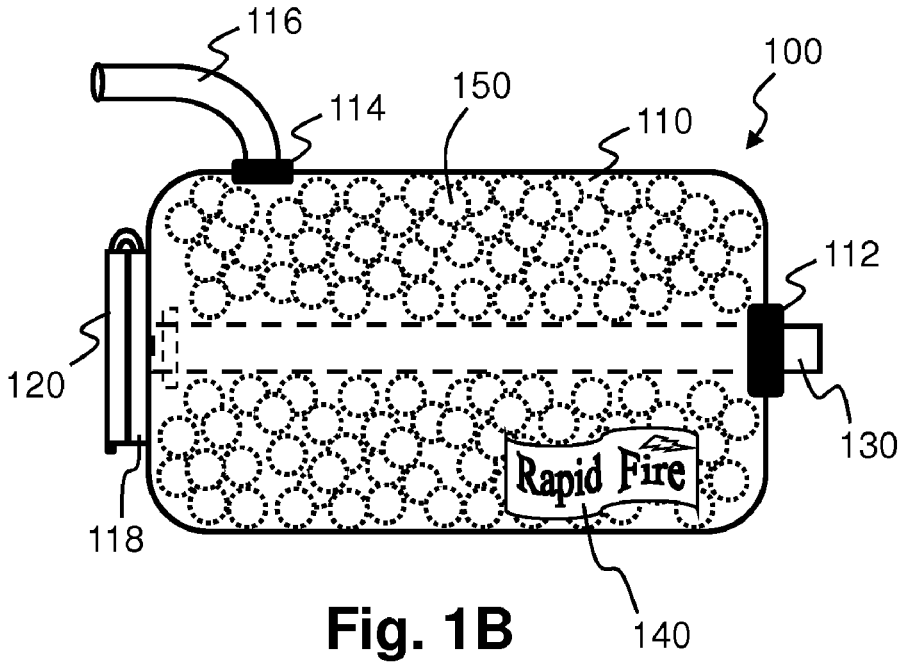
FIG. 1B depicts the blow gun of FIG. 1A, except loaded with spherical projectiles.

FIG. 1A is a top view of an unloaded blow gun 100 according to an embodiment of the present invention, with its barrel 130 in a storage position. FIG. 1B depicts the blow gun of FIG. 1A, except loaded with spherical projectiles 150. In certain embodiments, the blow gun 100 is sized to fire spherical projectiles 150 that are preferably hard plastic BBs. For example, certain embodiments are designed to preferably use standard hard plastic BBs that are readily available and marketed for use in conventional airsoft guns (e.g. 6 mm diameter hard plastic BBs). In such embodiments, 0.12 g hard plastic BBs may be preferred over 0.20 g hard plastic BBs, since a higher muzzle velocity may be obtained from lower mass BBs. However, considering the variation of pressure and flow rate of the shooter's exhaling breath, BBs of other masses or sizes may be practically employed.

In the embodiment of FIGS. 1A and 1B, the blow gun 100 includes a hollow ammunition chamber 110 that has an ammunition refill aperture 118, a breath receiving orifice 114, and a firing port 112. The ammunition chamber 110 preferably but not necessarily comprises plastic that is translucent rather than opaque. The ammunition chamber 110 may optionally have a surface that includes an adhered label 140. The label 140 may include one or more words or graphic markings printed thereon. The adhered label 140 is considered to be an integral part of the ammunition chamber 110 after it is joined thereto (by adhesive or the like).

A lid 120 may be removably positioned over the ammunition refill aperture 118. In certain embodiments, the lid 120 may prevent loss of ammunition (i.e. spherical projectiles 150) during storage via the ammunition refill aperture 118. This may be especially important if the blow gun 100 is carried by an active person (e.g. carried in a child's pocket while he/she is running, jumping, biking, etc). The lid 120 may also desirably reduce or prevent leakage of exhaled breath via the ammunition refill aperture 118, which may improve muzzle velocity. In certain embodiments the breath receiving orifice 114 may be used as the ammunition refill aperture, so that no separate ammunition refill aperture 118 is required. In such embodiments, the breath receiving orifice 114 may lack any tubular mouthpiece, and the lid 120 may optionally be a removable and replaceable lid over the breath receiving orifice 114 to retain ammunition when the gun is not in use.

The breath receiving orifice 114 of the hollow ammunition chamber 110 may optionally include a tubular mouthpiece 116 that protrudes from the ammunition chamber 110. In certain embodiments, the tubular mouthpiece 116 is preferably curved so that the shooter's exhaled breath may enter the internal volume of the ammunition chamber 110 in a direction that is transverse to the barrel 130 (to better disturb the spherical projectiles 150 therein), while the shooter is still able to face the target during shooting. The tubular mouthpiece 116 is considered to be an integral part of the breath receiving orifice 114 of the ammunition chamber 110, once joined thereto. Note that the material of the hollow ammunition chamber 110 may optionally be thicker at the breath receiving orifice 114 (as shown in the embodiment of FIGS. 1A and 1B), for example to reinforce the ability of the breath receiving orifice 114 to resist lateral forces and torques that may incidentally be exerted upon the tubular mouthpiece 116.

In certain embodiments, the breath receiving orifice 114 and/or the tubular mouthpiece 116 may be shaped and sized, and/or include a blocking feature, to prevent spherical projectiles 150 from traveling upstream towards the shooter's mouth. For example, the interior dimensions or shape of the tubular mouthpiece 116 may intentionally interfere with the spherical projectile outer diameter, and/or a blocking pin may prevent travel of the spherical projectiles 150 upstream through the tubular mouthpiece 116 should the shooter inhale. Such a blocking feature is considered to be an integral part of the breath receiving orifice 114 once joined thereto (or to the tubular mouthpiece 116).

In the embodiment of FIGS. 1A and 1B, the barrel 130 slightly obtrudes from the hollow ammunition chamber 110 through the firing port 112. The obtrusion is slight because the barrel 130 is shown in FIGS. 1A and 1B to be in its storage position (i.e. in the configuration of FIGS. 1A and 1B, the barrel 130 is pushed mostly into the internal volume of the hollow ammunition chamber 110). In certain embodiments, storing the barrel 130 within the internal volume of the hollow ammunition chamber may improve the concealability of the gun by reducing its maximum dimensions while stored.

In the embodiment of FIGS. 1A and 1B, the barrel 130 has a cylindrical bore therethrough, through which the spherical projectiles 150 may pass during firing of the blow gun 100. The cylindrical bore of the barrel 130 preferably defines an internal diameter that is greater than the diameter of the spherical projectiles 150 diameter but not greater than 1.7 times the diameter of the spherical projectiles 150. For example, in certain embodiments the cylindrical bore of the barrel 130 defines an internal diameter that is greater than 6 mm but less than 10 mm. The lower limit on the preferred diameter of the cylindrical bore of the barrel 130 ensures that the spherical projectiles 150 may pass, and the upper limit on the preferred diameter of the cylindrical bore of the barrel 130 ensures that the exhaled breath of the shooter imparts sufficient propelling force to the spherical projectiles 150 after they enter the cylindrical bore of the barrel 130.

In the embodiment of FIGS. 1A and 1B, the barrel 130 has a muzzle end 134 that is disposed outside of the ammunition chamber 110, and the barrel 130 has a breach end 136 that is opposite the muzzle end 134 and is disposed within the hollow ammunition chamber 110. The outer surface of the barrel 130 optionally includes a radially protruding flange 132 near the breach end 136, that is disposed within the hollow ammunition chamber 110, and that prevents the barrel 130 from sliding out of the ammunition chamber 110 beyond its firing position.

When the barrel 130 is in its storage position as shown in FIGS. 1A and 1B, the breach end 136 of the barrel 130 preferably but not necessarily abuts an inner boundary 138 of the ammunition chamber 110. In certain embodiments, such abutment may desirably prevent loss of ammunition (i.e. spherical projectiles 150) during storage, via the cylindrical bore of the barrel 130. Such prevention of ammunition loss via the barrel 130 during storage may become important if an active person is carrying the gun (e.g. the gun is carried in a child's pocket while he/she is running, jumping, biking, etc). The inner boundary 138 may be an interior surface of the ammunition chamber 110, or else may be an interior surface of the lid 120, depending on the location chosen for the ammunition refill aperture 118.

In the embodiment of FIGS. 1A and 1B, the barrel 130 also has an outer surface that is in sliding contact with the firing port 112. The term "sliding contact" as used herein includes the situation where the barrel 130 locks in place after sliding into its firing position or its storage position (e.g. first slides and then locks). For example, the barrel 130 and/or firing port 112 may optionally include one or more conventional twist-lock features that temporarily fix the barrel 130 in its firing position or in its storage position. Still, the contact between the barrel 130 and the firing port 112 is said to be a "sliding contact." Also conventional twist-lock features are considered to be an integral part of the barrel 130 and/or the firing port 112, once formed therein or joined thereto.

Figure 2A:
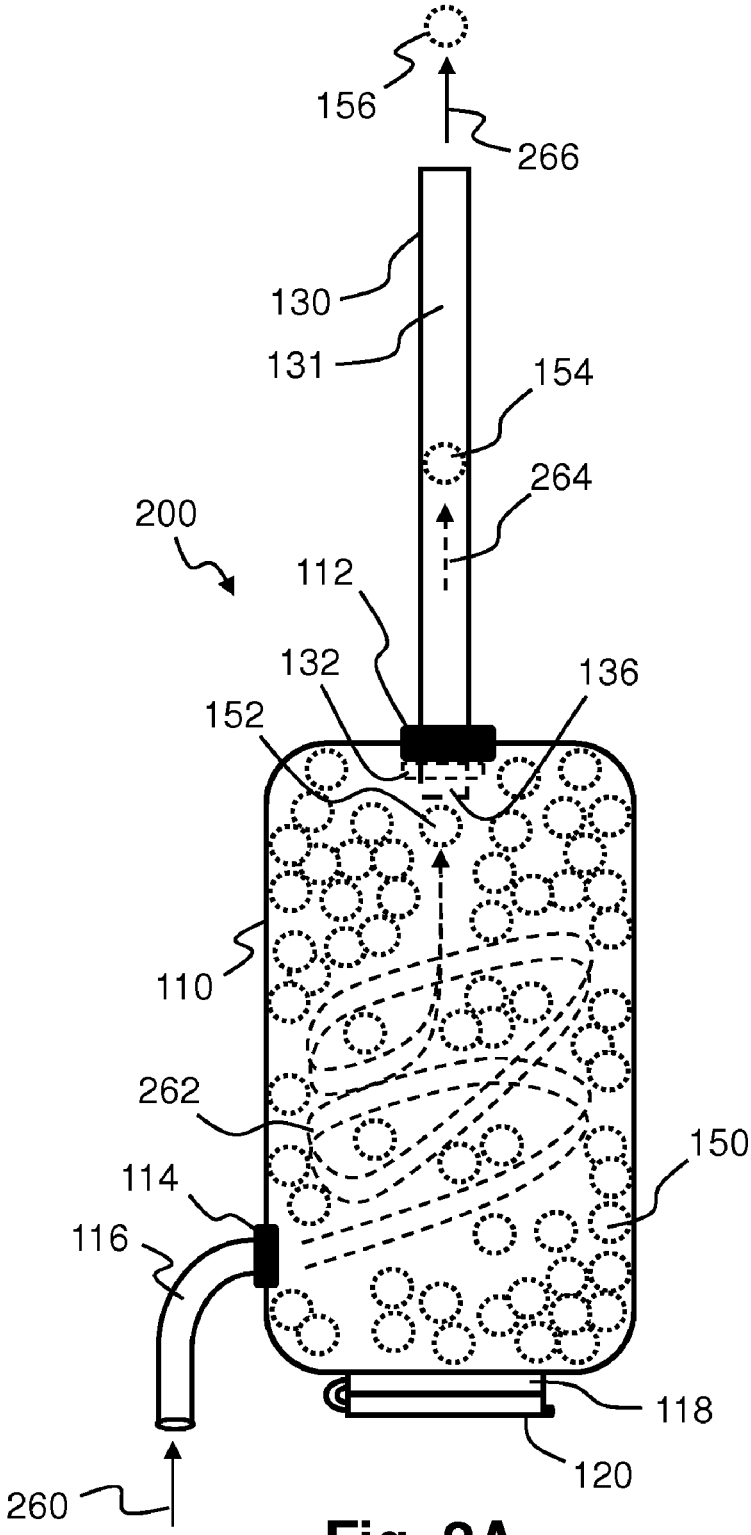
FIG. 2A is a top view of a loaded blow gun according to an embodiment of the present invention, during operation and with its barrel in the firing position.
Figure 2B:
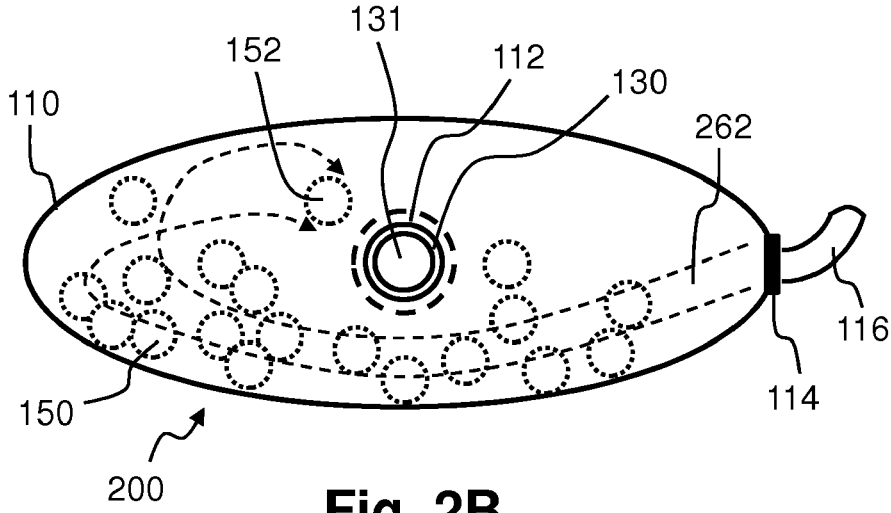
FIG. 2B is a front view of the loaded blow gun of FIG. 2A, during operation.

FIG. 2A is a top view of a loaded blow gun 200 according to an embodiment of the present invention, during operation and with its barrel 130 in the firing position. FIG. 2B is a front view of the loaded blow gun of FIG. 2A, during operation. To enhance the conciseness of the present description, features of the blow gun 200 that are similar to like features of the blow gun 100, and that have already been explained with reference to FIGS. 1A and 1B, are labeled herein with the same numbers in FIGS. 2A and 2B as in FIGS. 1A and 1B, and are not re-explained with reference to FIGS. 2A and 2B.

In FIG. 2A, the barrel 130 is in its firing position and most of the barrel 130 is disposed outside of the ammunition chamber 110. The flange 132, that radially protrudes from the barrel 130 near its breach end 136, is shown in FIG. 2A to prevent the barrel 130 from sliding out of the hollow ammunition chamber 110 beyond the firing position that is shown. Note that the material of the hollow ammunition chamber 110 may optionally be thicker around the firing port 112 (as shown in FIG. 2A), for example to reinforce the ability of the firing port 112 to resist lateral forces and torques that may incidentally be exerted upon the barrel 130 when it is extended in its firing position.

During operation of the embodiment shown in FIGS. 2A and 2B, the shooter exhales breath 260 through the tubular mouthpiece 116 of the breath receiving orifice 114, and into the internal volume of the ammunition chamber 110. The exhaled breath 260 preferably vigorously swirls within the internal volume of the ammunition chamber 110, so as to disturb the spherical projectiles 150 stored within. The disturbance frequently causes one of the spherical projectiles (e.g. 152) to be carried to the breach end 136 of the barrel 130, where the exhaled breath 260 forces it into the cylindrical bore 131 of the barrel 130. Inside the cylindrical bore 131 of the barrel 130, the exhaled breath 260 pushes behind earlier carried spherical projectile 154, increasing its muzzle velocity. In FIG. 2A, the exhaled breath 260 is shown exiting the blow gun 200 via the muzzle end 134 of the barrel 130, behind the spherical projectile 156 (which is shown traveling freely towards its target).

As shown in FIGS. 2A and 2B, the ammunition chamber 110 has an internal volume that is large enough to hold at least 30 of the spherical projectiles 150. Preferably, the internal volume of the ammunition chamber 110 is large enough to allow the shooter's breath to swirl within the internal volume and disturb the spherical projectiles 150, so that one or more of the spherical projectiles 150 may be frequently and randomly positioned to feed into the cylindrical bore 131 of the barrel 130 (at the breach end 136 of the barrel when the barrel is in its firing position).

In the embodiment of FIG. 2B, the internal volume of the ammunition chamber 110 is shown to have an oval shape (in the cross-section that would be transverse to the barrel 130). In certain embodiments, the internal volume of the ammunition chamber 110 preferably may have a circular or oval cross section, to allow the spherical projectiles 150 to maintain their momentum without blunt collisions while being carried by the swirling breath 262. In such embodiments, this may enhance the likelihood that one or more of the spherical projectiles (e.g. spherical projectile 152) may be frequently and randomly positioned to feed into the cylindrical bore 131 of the barrel 130.

Figure 3:
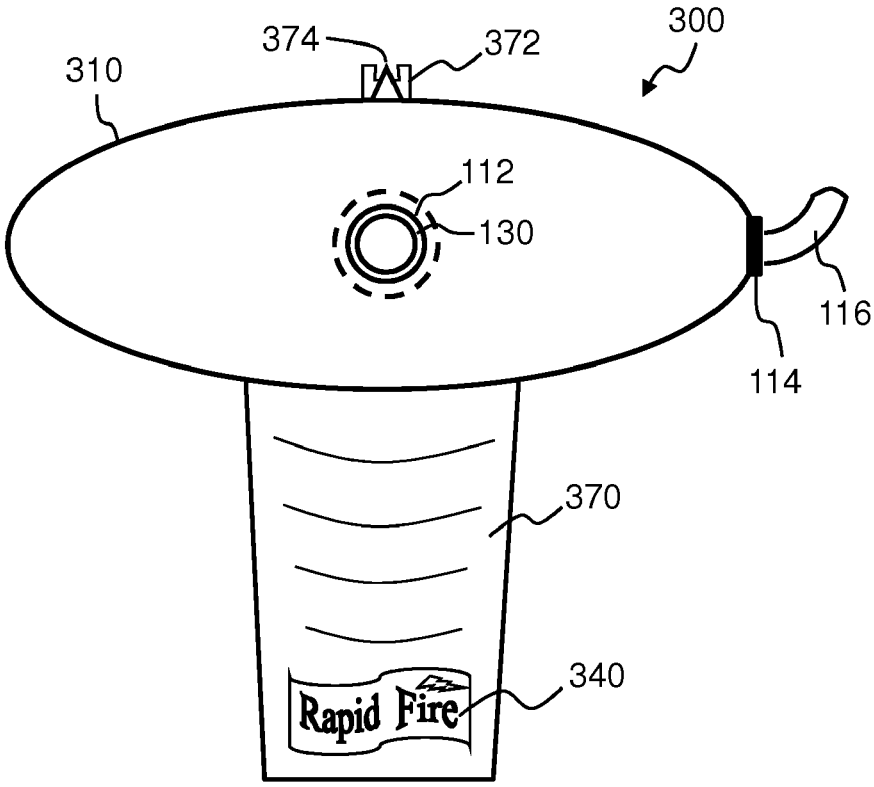
FIG. 3 is a front view of a loaded blow gun according to another embodiment of the present invention, during operation.

FIG. 3 is a front view of a loaded blow gun 300 according to another embodiment of the present invention, during operation. To enhance the conciseness of the present description, features of the blow gun 300 that are similar to like features of the blow guns that have already been described in previous paragraphs, are labeled herein with the same numbers and are not re-explained with reference to FIG. 3.

In the embodiment of FIG. 3, the hollow ammunition chamber 310 optionally includes a handle 370 that protrudes from the ammunition chamber 310. The handle 370 is considered to be an integral part of the ammunition chamber 310 once it is joined thereto. The handle 370 of the ammunition chamber 310 may optionally have a surface that includes an adhered label 140. The label 140 may include one or more words or graphic markings printed thereon. The adhered label 140 is considered to be an integral part of the ammunition chamber 310, after it is joined with the handle 370 of the ammunition chamber 310 (by adhesive or the like).

In the embodiment of FIG. 3, the ammunition chamber 310 may also optionally include sight alignment features 372 and 374. The sight alignment features 372 and 374 may be used for aiming the blow gun 300. The sight alignment features 372 and 374 are considered to be integral parts of the ammunition chamber 310 once they are created or affixed thereon.

Figure 4A:
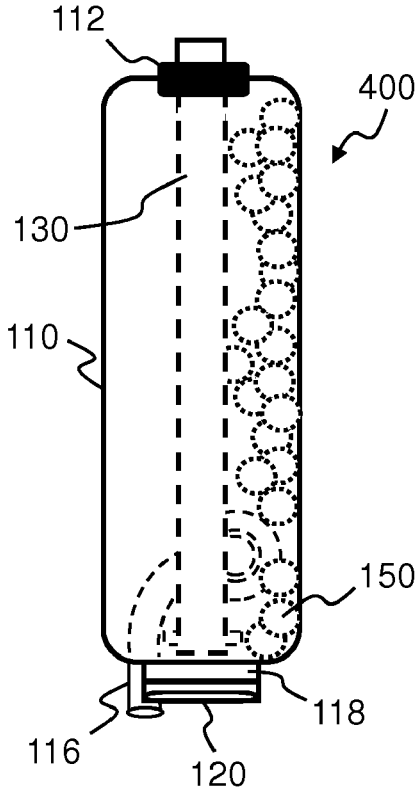
FIG. 4A is a side view of a loaded blow gun according to an embodiment of the present invention, with its barrel in the storage position.
Figure 4B:
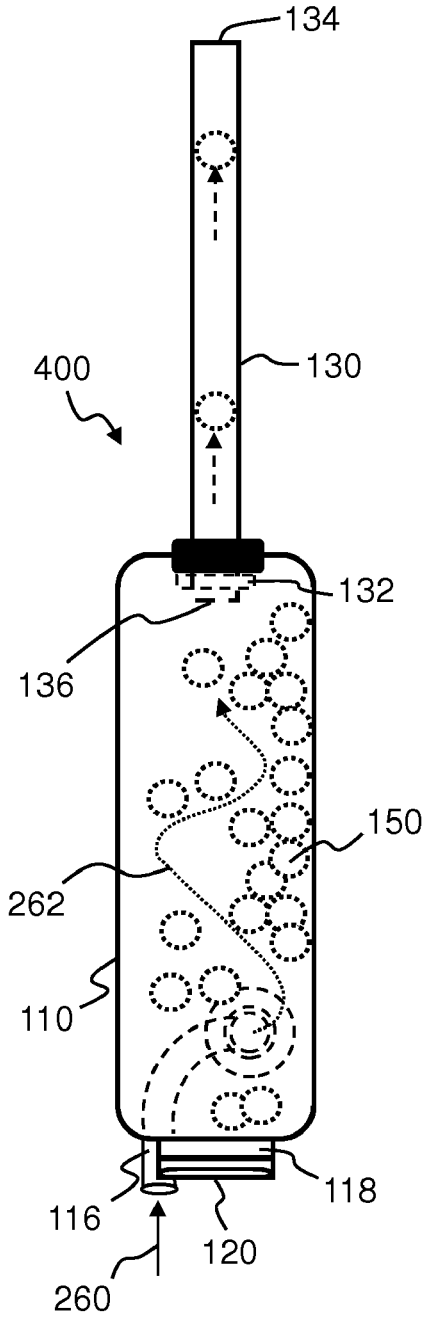
FIG. 4B is a side view of a loaded blow gun according to an embodiment of the present invention, during operation and with its barrel in the firing position.

FIG. 4A is a side view of a loaded blow gun according to an embodiment of the present invention, with its barrel 130 in the storage position. FIG. 4B is a side view of the loaded blow gun 400 during operation and with its barrel 130 in the firing position. To enhance the conciseness of the present description, features of the blow gun 400 that are similar to like features of the blow guns that have already been described in previous paragraphs, are labeled herein with the same numbers and are not re-explained with reference to FIGS. 4A and 4B.

As shown in FIGS. 4A and 4B, the internal volume of the hollow ammunition chamber 110 is preferably not completely filled with spherical projectiles 150. Preferably, the hollow ammunition chamber 110 is filled no more than two-thirds full with spherical projectiles 150 during operation. Otherwise, the exhaled breath 262 of the shooter may not swirl sufficiently within the internal volume of the hollow ammunition chamber 110 to disturb and carry spherical projectiles 150 to random positions near enough the breach end 136 of the barrel 130 to facilitate rapid fire. Most preferably, the hollow ammunition chamber 110 is filled no more than one-half full with spherical projectiles 150 during operation.

Figure 5:
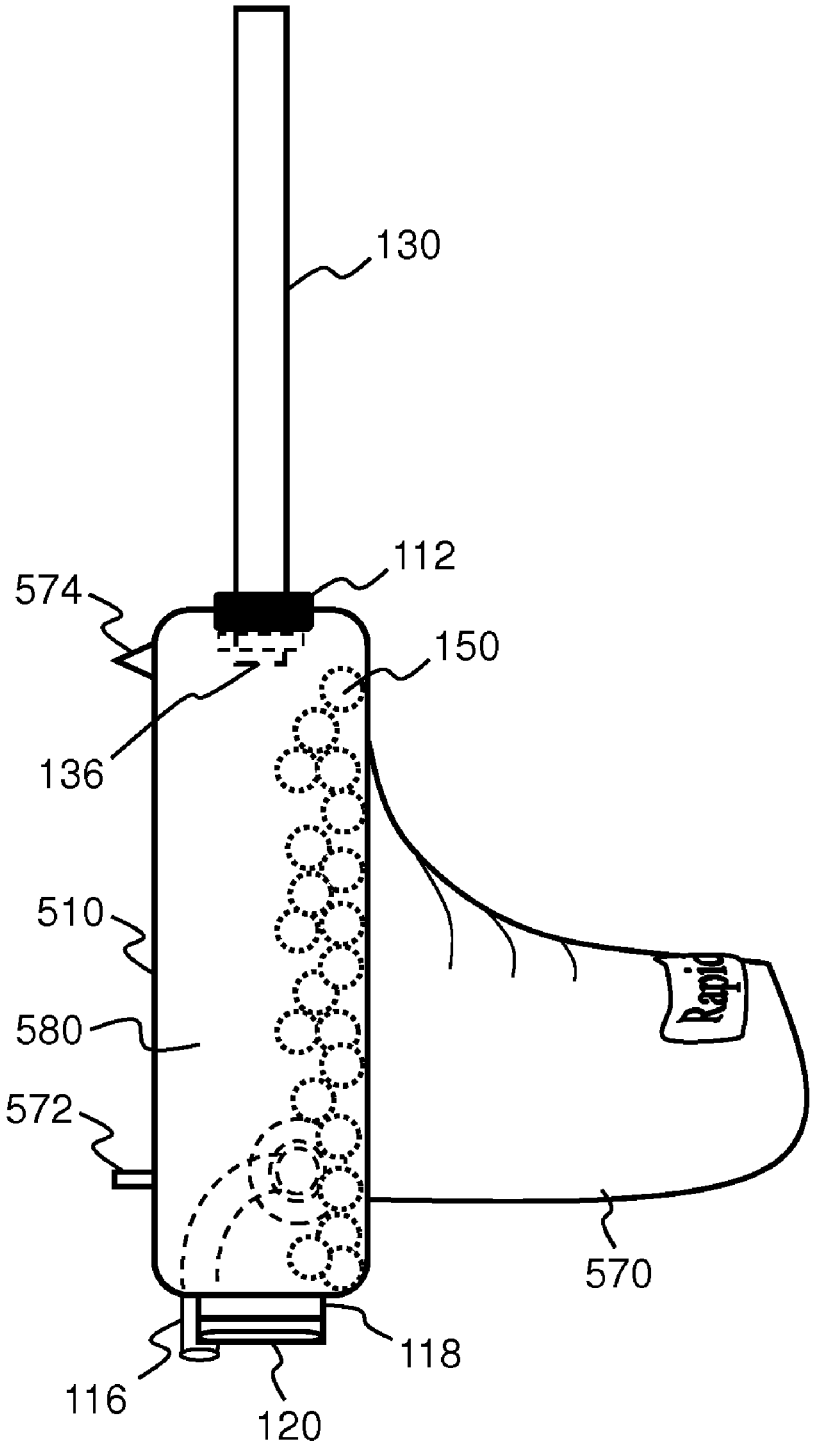
FIG. 5 is a side view of a loaded blow gun according to another embodiment of the present invention, with its barrel in the firing position.

FIG. 5 is a side view of a loaded blow gun according to another embodiment of the present invention, with its barrel in the firing position. To enhance the conciseness of the present description, features of the blow gun 500 that are similar to like features of the blow guns that have already been described in previous paragraphs, are labeled herein with the same numbers and are not re-explained with reference to FIG. 5.

In the embodiment of FIG. 5, the ammunition chamber 510 optionally includes a handle 570 that protrudes from the ammunition chamber 510. The handle 570 is considered to be an integral part of the ammunition chamber 510 once it is joined thereto. In certain embodiments, the handle 570 is fabricated from a resilient material (e.g. a soft polymeric material) so that the shooter can squeeze it as ammunition is being depleted, forcing additional ammunition upward into the upper portion 580 of the hollow ammunition chamber 510 where the shooter's breath is swirling. In such embodiments, as the portion of the hollow ammunition chamber 510 where the shooter's breath is swirling is being depleted of ammunition by firing, and replenished by the shooter squeezing the handle 570, a one way flap (that is part of the handle 570) may prevent replenished ammunition from sinking back into the handle 570. Alternatively, the shooter can simply maintain pressure on the handle 570 to prevent such sinking back of ammunition.

In the embodiment of FIG. 5, the hollow ammunition chamber 510 may also optionally include sight alignment features 572 and 574. The sight alignment features 572 and 574 may be used for aiming the blow gun 500. The sight alignment features 572 and 574 are considered to be integral parts of the hollow ammunition chamber 510 once they are created or affixed thereon.

As shown in FIG. 5, the internal volume of the hollow ammunition chamber 510 is preferably not completely filled with spherical projectiles 150. Preferably, the hollow ammunition chamber 510 is filled no more than two-thirds full with spherical projectiles 150 during operation. Otherwise, the exhaled breath of the shooter may not swirl sufficiently within the internal volume of the hollow ammunition chamber 510 to disturb and carry spherical projectiles 150 to random positions near enough the breach end of the barrel 130 to facilitate rapid fire. Most preferably, the hollow ammunition chamber 510 is filled no more than one-half full with spherical projectiles 150 during operation.

In the foregoing specification, the invention is described with reference to specific exemplary embodiments, but those skilled in the art will recognize that the invention is not limited to those. It is contemplated that various features and aspects of the invention may be used individually or jointly and possibly in a different environment or application. The specification and drawings are, accordingly, to be regarded as illustrative and exemplary rather than restrictive. For example, the word "preferably," and the phrase "preferably but not necessarily," are used synonymously herein to consistently include the meaning of "not necessarily" or optionally. "Comprising," "including," and "having," are intended to be open-ended terms. The phrase "consisting of" is intended to be closed-ended so as to exclude additional elements that do not pertain to those elements that are recited, but not to foreclose the possibility of sub-parts or sub-components of the elements that are recited.

What is claimed:

1. A blow gun to fire spherical projectiles, each spherical projectile defining a spherical projectile diameter, the blow gun consisting of:

an ammunition chamber having an internal volume that is large enough to hold at least 30 of the spherical projectiles, the ammunition chamber having an ammunition refill aperture;

a barrel obtruding from the ammunition chamber, the barrel having a cylindrical bore therethrough, the cylindrical bore defining an internal diameter that is greater than the spherical projectile diameter but no greater than 1.7 times the spherical projectile diameter; and a lid over the ammunition refill aperture;

wherein the ammunition chamber has a breath receiving orifice for receiving exhaled breath into the ammunition chamber, and the ammunition chamber includes a resilient handle portion that is squeezable to displace spherical projectiles within the ammunition chamber.

2. The blow gun of claim 1 wherein the ammunition chamber includes an upper portion from which the barrel obtrudes, and the resilient handle portion is squeezable to replenish spherical projectiles from the resilient handle portion into the upper portion.

3. The blow gun of claim 1 wherein the ammunition chamber has a surface with an adhered label including a word or graphic marking.

4. The blow gun of claim 1 wherein the ammunition chamber includes at least one sight alignment feature for aiming.

5. The blow gun of claim 2 wherein the upper portion of the ammunition chamber has a circular or oval cross-section.

6. The blow gun of claim 2 wherein the breath receiving orifice includes a curved tubular mouthpiece that protrudes from the upper portion of the ammunition chamber.

7. The blow gun of claim 2 wherein the barrel includes a muzzle end disposed outside of the ammunition chamber, and the barrel includes a breach end opposite the muzzle end and disposed within the upper portion of the ammunition chamber.

8. The blow gun of claim 1 wherein the cylindrical bore of the barrel defines an internal diameter that is greater than 6 mm but less than 10 mm.

9. The blow gun of claim 1 wherein the breath receiving orifice is the ammunition refill aperture.

10. A blow gun to fire spherical projectiles, each spherical projectile defining a spherical projectile diameter, the blow gun comprising:

an ammunition chamber having an internal volume that is large enough to hold at least 30 of the spherical projectiles;

a barrel obtruding from the ammunition chamber, the barrel having a cylindrical bore therethrough, the cylindrical bore defining an internal diameter that is greater than the spherical projectile diameter but no greater than 1.7 times the spherical projectile diameter;

wherein the ammunition chamber has a breath receiving orifice for receiving exhaled breath into the ammunition chamber, and the ammunition chamber includes a resilient handle portion that is squeezable to displace spherical projectiles within the ammunition chamber.

11. The blow gun of claim 10 wherein the ammunition chamber includes an upper portion from which the barrel obtrudes, and the resilient handle portion is squeezable to replenish spherical projectiles from the resilient handle portion into the upper portion.

12. The blow gun of claim 11 wherein the ammunition chamber further includes an ammunition refill aperture in the upper portion, and a lid over the ammunition refill aperture.

13. The blow gun of claim 11 wherein the upper portion of the ammunition chamber has a circular or oval cross-section.

14. The blow gun of claim 11 wherein the breath receiving orifice includes a curved tubular mouthpiece that protrudes from the upper portion of the ammunition chamber.

15. The blow gun of claim 11 wherein the barrel includes a muzzle end disposed outside of the ammunition chamber, and the barrel includes a breach end opposite the muzzle end and disposed within the upper portion of the ammunition chamber.

16. The blow gun of claim 10 wherein the cylindrical bore of the barrel defines an internal diameter that is greater than 6 mm but less than 10 mm.

* * * * *